US005429355A

United States Patent [19]

Schmidt et al.

[11] Patent Number: 5,429,355

[45] Date of Patent: * Jul. 4, 1995

[54] GOLF CLUB HEAD TO SHAFT CONNECTION

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Nov. 24, 2009 has been disclaimed.

[21] Appl. No.: 91,773

[22] Filed: Jul. 14, 1993

Related U.S. Application Data

[63] Continuation-in-part of Ser. No. 973,944, Nov. 9, 1992, Pat. No. 5,275,399, which is a continuation of Ser. No. 743,432, Aug. 9, 1991, Pat. No. 5,165,688.

[51] Int. Cl.[6] ..... A63B 53/02

[52] U.S. Cl. ..... 273/80 B; 273/80.2; 273/80.6; 29/525; 403/290

[58] Field of Search ..... 273/80.1–80.9, 273/167 R–77 A, 80 R, 80 B, 77 R, 164.1, 162 R; 29/428, 525, 515, 516, 520; 403/289, 290, 361

[56] References Cited

U.S. PATENT DOCUMENTS

| | | | |
|---|---|---|---|
| 1,639,547 | 8/1927 | Barnhart . | |
| 1,892,482 | 12/1932 | Cash, Jr. . | |
| 1,895,417 | 1/1933 | Lard . | |
| 1,980,031 | 11/1934 | Brading . | |
| 2,018,898 | 10/1935 | Reach . | |
| 2,067,556 | 1/1937 | Wettlaufer . | |
| 2,203,893 | 6/1940 | Chapman . | |
| 2,231,847 | 2/1941 | Dickson et al. . | |
| 3,661,388 | 5/1972 | Leslie . | |
| 4,432,549 | 2/1984 | Zebelean . | |
| 4,470,600 | 9/1984 | Parente et al. . | |
| 4,512,577 | 4/1985 | Solheim . | |
| 4,854,582 | 8/1989 | Yamada . | |
| 4,948,132 | 8/1990 | Wharton . | |
| 4,958,834 | 9/1990 | Colbert . | |
| 4,984,794 | 1/1991 | Pernelle et al. . | |
| 4,995,609 | 2/1991 | Parente et al. . | |
| 5,165,688 | 11/1992 | Schmidt et al. . | |
| 5,275,399 | 1/1994 | Schmidt | 273/80 B |

FOREIGN PATENT DOCUMENTS

| | | |
|---|---|---|
| 8606286 | 11/1986 | France . |
| 2626187 | 7/1989 | France . |
| 344031 | 11/1989 | France . |
| 208553 | 6/1924 | United Kingdom . |
| 267398 | 3/1927 | United Kingdom . |
| 2144042 | 2/1985 | United Kingdom . |
| 2230459 | 1/1990 | United Kingdom . |

*Primary Examiner*—Sebastiano Passaniti
*Attorney, Agent, or Firm*—William W. Haefliger

[57] ABSTRACT

A golf club having a head and a shaft defining an axis, the head having a heel, a toe, a top, and a bottom, an improved connection of the shaft to the head comprising a socket associated with the head, the socket having inner wall structure extending in the direction of the axis, and with annular wall portions relatively angled at axially successive locations in the direction, at least one of the wall portions providing a locally camming surface; the shaft having a lower end portion forcibly received endwise into the socket, and collapsed at least in part toward the axis in response to the forcible reception of the shaft lower end portion into the socket, and against the camming surface; the wall structure forming with the shaft lower end portion a clearance axially offset from-the camming surface for reception of adhesive to contact the shaft lower end portion and to cure and adhere the shaft lower end portion to the wall structure.

22 Claims, 6 Drawing Sheets

GOLF CLUB HEAD TO SHAFT CONNECTION

This application is a continuation-in-part of Ser. No. 07/973,944 filed Nov. 9, 1992, now U.S. Pat. No. 5,275,399 which is a continuation of Ser. No. 07/743,432, Aug. 9,1991 , now U.S. Pat. No. 5,165,688, issued Nov. 24, 1992.

BACKGROUND OF THE INVENTION

This invention relates generally to golf clubs, and more particularly to connection of a golf club head to a shaft to achieve certain advantages.

Many efforts have been made to reallocate metallic weight from the hosel area of a golf club to the head itself, in order to achieve higher energy availability for transfer when the club is swung. Such greater energy or momentum is then transferred to the golf ball when struck. This requires, for example, reduction of metal at the hosel area of the club.

Such efforts have included configurations wherein a shaft passed through the head of a persimmon wood. Typical of such configurations were: Wilson's staff model "Dynopower Fluid Feel" wood, produced around 1957; Wilson's "Helen Hicks" wood, produced in the 1920's; and certain MacGregor woods, produced in the late 1930's. See also U.S. Pat. No. 4,995,609 entitled "Iron Golf Club Heads" assigned to Callaway Golf Company, disclosing a hosel characterized by reduced mass or weight.

No way was known, to our knowledge, to connect a shaft to a golf club iron head, where the shaft passed into proximity to the bottom of the head and was reduced in diameter at or near the bottom of the head so as not to interfere with an edge or edges of the sole; also, no way was known to connect such a shaft to a non-constant tapered bore in an iron hosel to provide a tight interference fit along localized extent of the shaft and bore, upon axial assembly, enabling very good tactile "feedback" sensing, to the player, of head-to-ball impact, and also providing annular space for adhesive reception between the shaft and bore near the bore taper.

Further, locking of the collapsed end of a shaft to a bore, by local expansion of the collapsed end, was not known.

SUMMARY OF THE INVENTION

It is a major object of the invention to provide an improved connection between a golf club head and shaft which meets the above needs, the head typically being an iron, but the head also referring to a wedge, chipper, putter, wood, or other type. Basically, the invention includes or comprises:

a) a socket associated with the head, the socket having inner wall means extending in the direction of the axis, and with annular wall portions relatively angled at axially successive locations in that direction, at least one of the wall portions providing a locally camming surface, b) the shaft having a lower end portion forcibly received endwise into the socket, and collapsed at least in part toward the axis in response to the forcible reception of the shaft lower end portion into the socket, and against the camming surface, c) the wall means forming with the shaft lower end portion a clearance axially offset from the camming surface for reception of adhesive to contact the shaft lower end portion and to cure and adhere the shaft lower end portion to the wall means.

As will be seen, the socket may have intersection with the bottom of the head, the shaft lower end portion having cantilever sections, such as fingers, with lower ends closing toward one another at or near that intersection, whereby a limit or resistance to collapse of the cantilever sections is produced along with formation of a frictionally jammed-together connection, the latter also enhanced by adhesive bonding. Such bonding is facilitated by the adhesive-receiving space formed between the shaft and bore in offset relation to the camming surface of the bore. In this regard, the sections lower ends typically may have lateral interengagement proximate the intersection. The lowermost end of the shaft alternatively may not intersect the bottom of the head.

Another object is the provision for locking (as for example by staking) of the shaft lowermost collapsed extent, which is then locally expanded.

A further object is the provision of a graphite shaft tapered end connection to a head hosel, as will be seen.

These and other objects and advantages of the invention, as well as the details of an illustrative embodiment, will be more fully understood from the following specification and drawings, in which:

DRAWING DESCRIPTION

Figure 6:
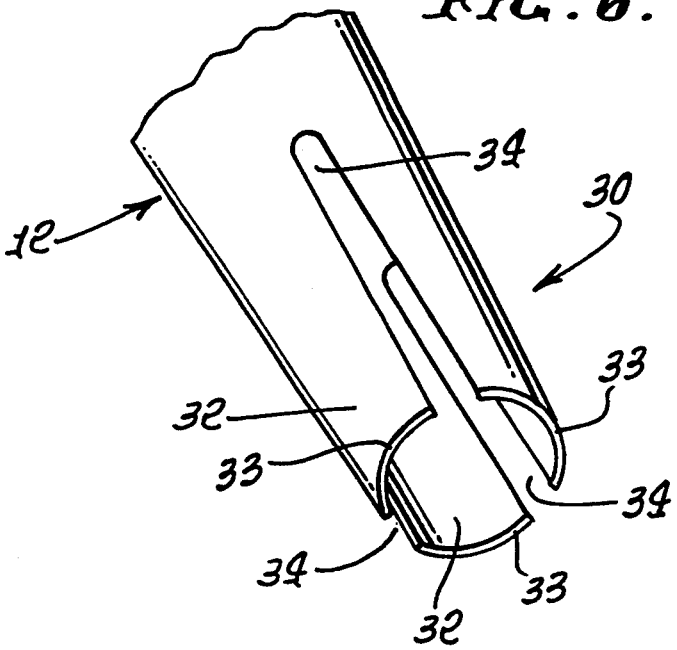
FIG. 6 is a perspective view of the shaft lower end before its reception into the hosel and tapered socket.
Figure 7:
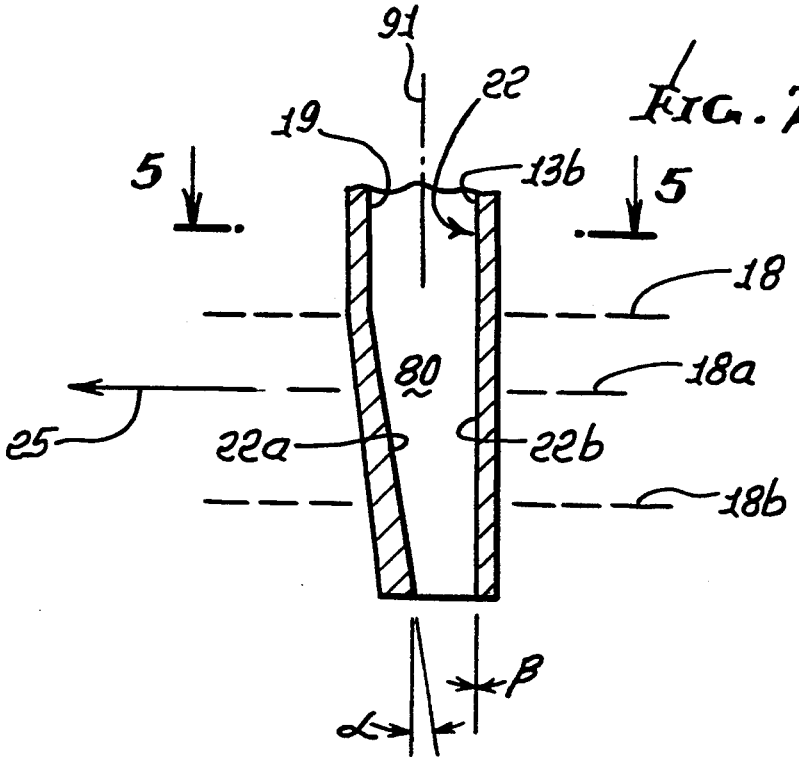
Figure 9:
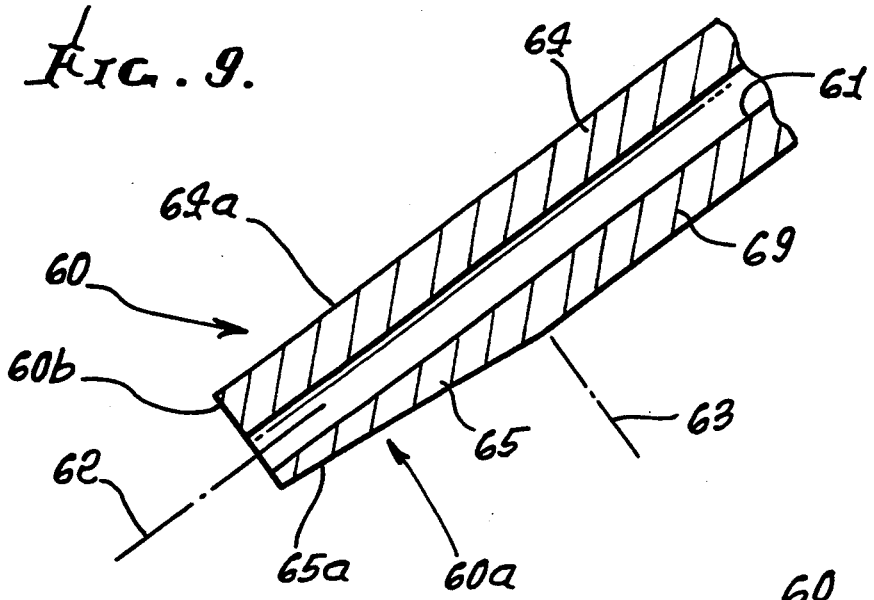
Figure 8:
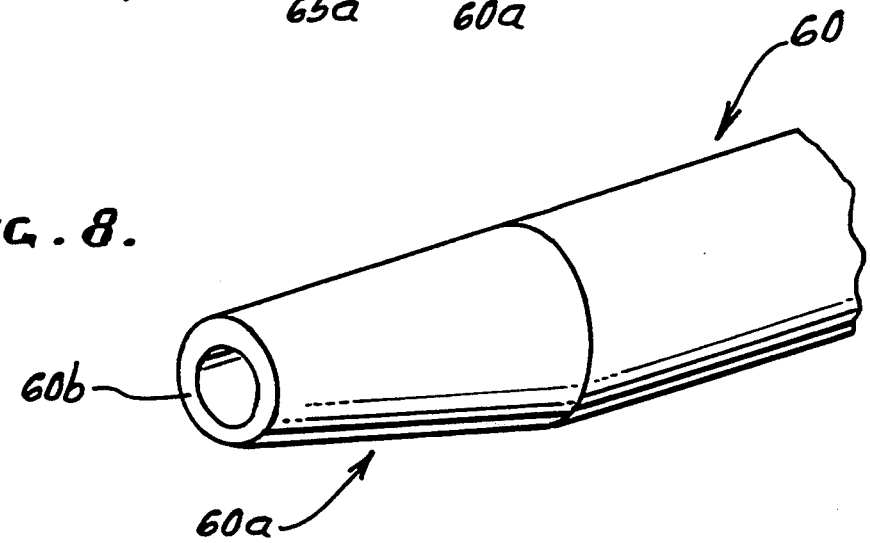
Figure 10:
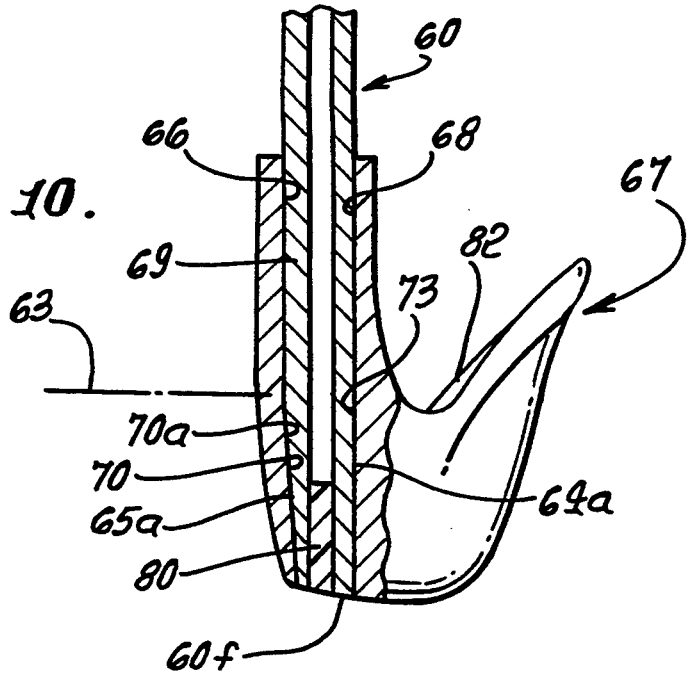
Figure 11:
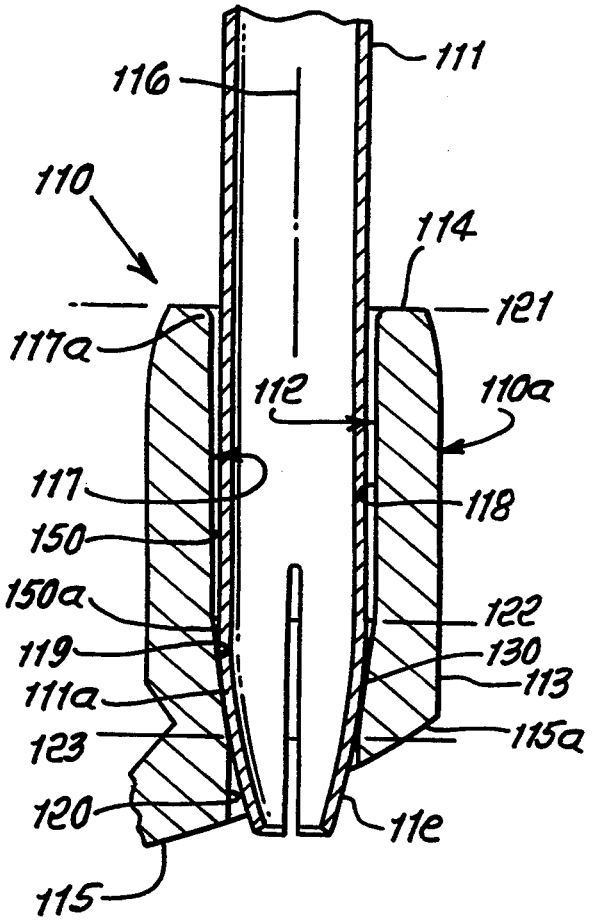
Figure 12:
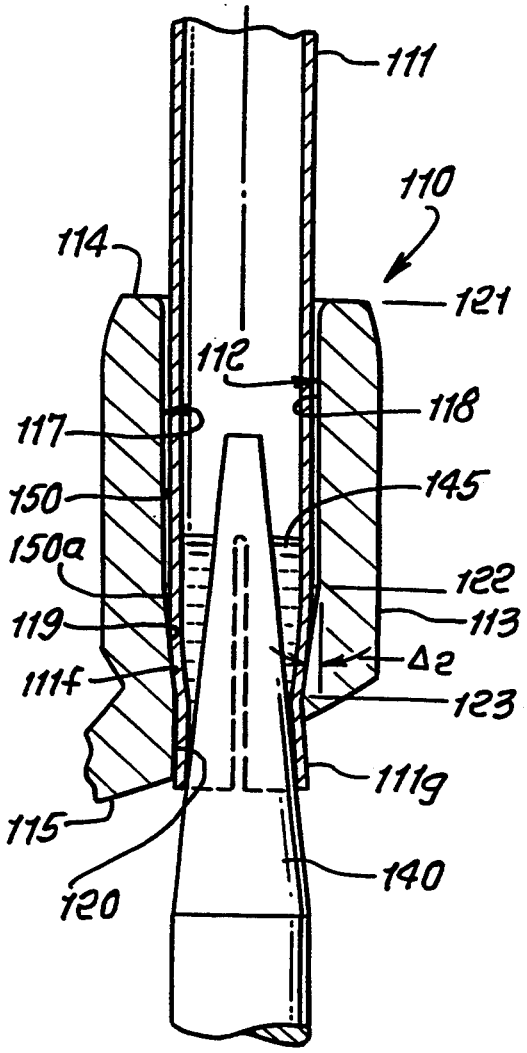
Figure 13:
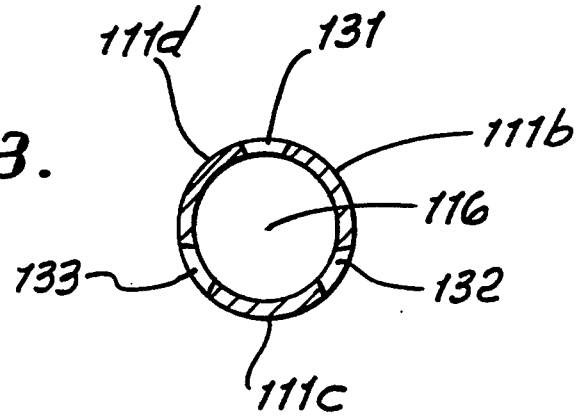

FIG. **6*a* is like FIG. 6** but shows shaft cantilever portions closed together at their lower ends;

FIG. 7 is a vertical section taken through the tapered socket in the lower end of the hosel;

FIG. 8 is a fragmentary perspective view of a tapered graphite shaft;

FIG. 9 is an endwise cross section taken through the FIG. 8 shaft;

FIG. 10 is a view showing the FIG. 8 shaft assembled into a club head;

FIG. 11 is a view like FIG. 10 showing a modification;

FIG. 12 is a view like FIG. 11 showing locking of the shaft to the hosel;

FIG. 13 is a section showing shaft lower end tongues; and

Figure 14:
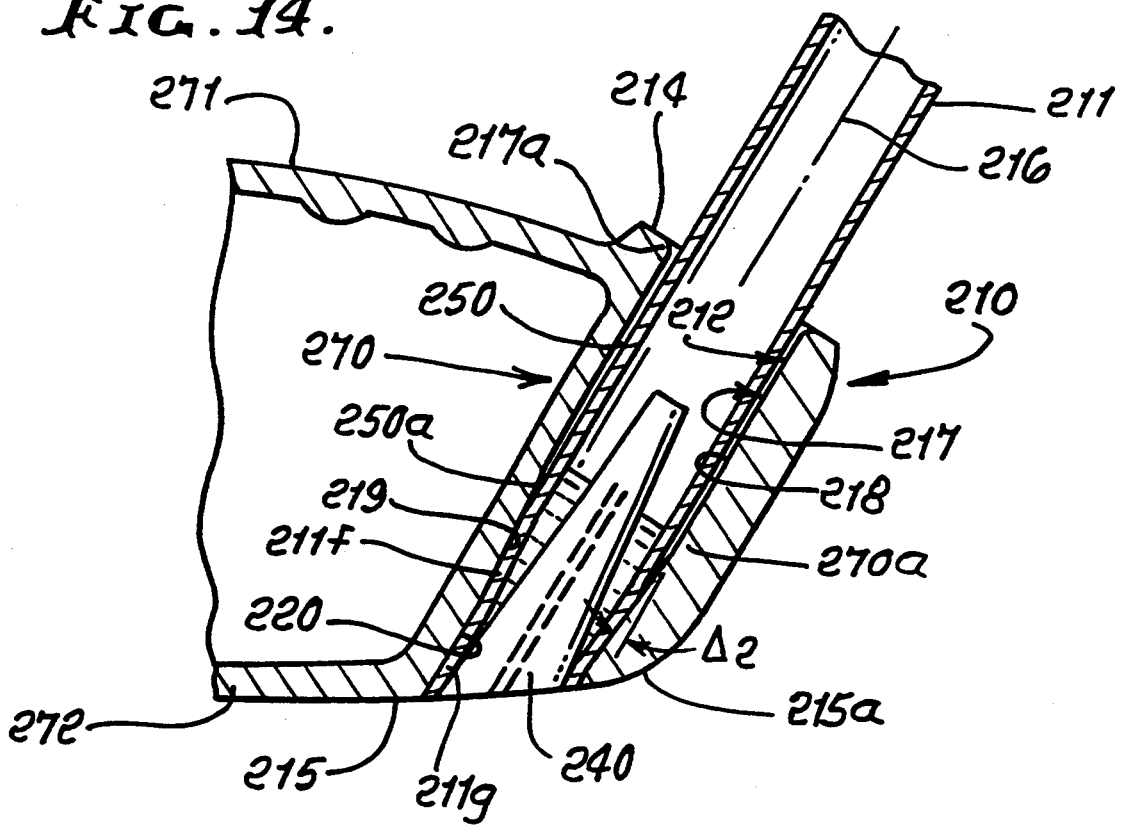

FIG. 14 is a view like FIG. 10 but showing a further modified form of the invention, as applied to a wood.

DETAILED DESCRIPTION

In the drawings, a golf club 10, such as an iron, has a head 11 and a ferrule 12. Also shown is a hosel 13, typically formed or cast as part of the head, the latter consisting of metal or other material. A socket 14 is associated with the head and has an inner wall, the lower extent of which tapers in an endwise downward direction, generally toward the bottom 15 of the head at the heel. In this regard, the socket preferably has intersection at 16 with the head bottom 15, proximate heel 11*b*, that intersection typically being oval shaped due to angularity of bottom 15 relative to the socket axis.

Figure 4:
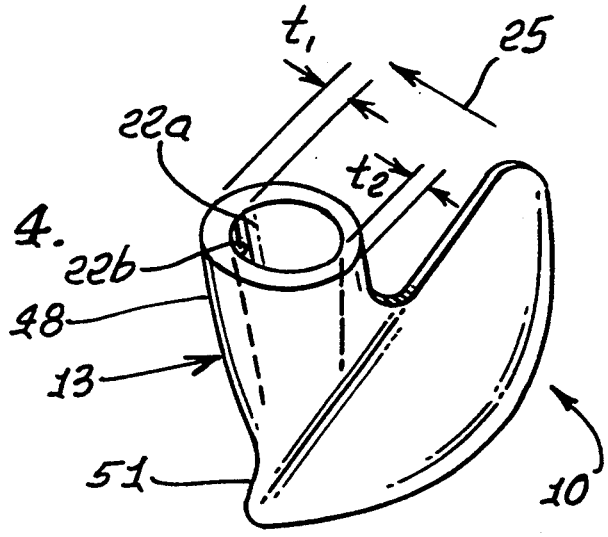
FIG. 4 is a rear end perspective view of the section of the FIGS. 1–3 head and hosel.
Figure 5:
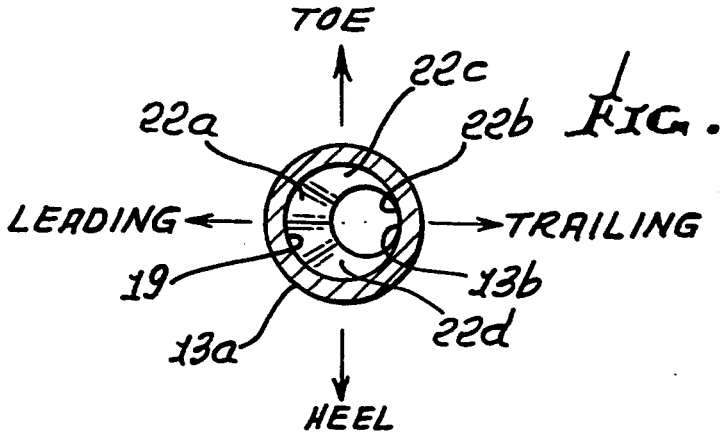
FIG. 5 is a top plan view taken at the upper end of the hosel.

FIGS. 5 and 7 show that the socket taper commences at a zone indicated by line or plane 18 below a lengthwise, straight, circular cross section bore 19 in the hosel and that extends from the upper end 21 of the hosel to horizontal plane 18. Bore 19 may be conical. The taper angle of the socket interior wall 22 preferably varies, as for example appears in FIGS. 5 and 7, though such variable taper may approach zero, defining a cone. Thus, the forward (leading) side 22*a* of wall 22 has relatively greater taper angularity $\alpha$, relative to vertical; and the rearward (trailing) side 22*b* of the wall 22 has relatively lesser angularity $\beta$ (typically zero) relative to vertical, providing differential tapers, as shown. The taper angles of wall sides 22*c* and 22*d* lie between $\alpha$ and $\beta$. Thus, the tapered bore 80 is eccentric relative to the cylindrical outer surface 13*a* of the upper hosel, above plane 18, and relative to the hosel bore 13*b* above that plane. Further, the socket bore cross sections are circular or near circular, as at planes 18*a* and 18*b* parallel to 18, which are normal to hosel axis 91. In this regard, the forward stroking direction is that indicated by arrow 25 in FIGS. 4, 5, and 7, i.e., the direction toward which the head front face 11*a* faces (the ball striking direction). Angle $\beta$ may be reduced to zero, as for a cylindrical shaft, or may be equal to a standard taper (0.00375 inches per inch of length on one side). Angle $\alpha$ is between about 1 to about 8 degrees.

Further in this regard, the wall thickness of the hosel above plane 18 may also vary, as indicated, and may be circular, conical, or elliptical, for example. Thus, the thickness $t_1$ at the forward side of the hosel may be about the same as or greater than the thickness $t_2$at the rearward side of the hosel. This relationship may be produced by forming bore 19 eccentrically relative to the cylindrical outer surface of the hosel, or it may be non-cylindrical or ellipsoidal. The main axis of the bore/shaft and the main axis of the outer configuration of the hosel proper may be approximately aligned or slightly skewed. These relationships contribute to a spacial relationship of the hosel to the head face leading edge juncture 50 and 51 allowing reallocation of weight to the head itself (i.e., between the toe, top, and sole area) for greater or more focused momentum during club swinging.

Figure 1:
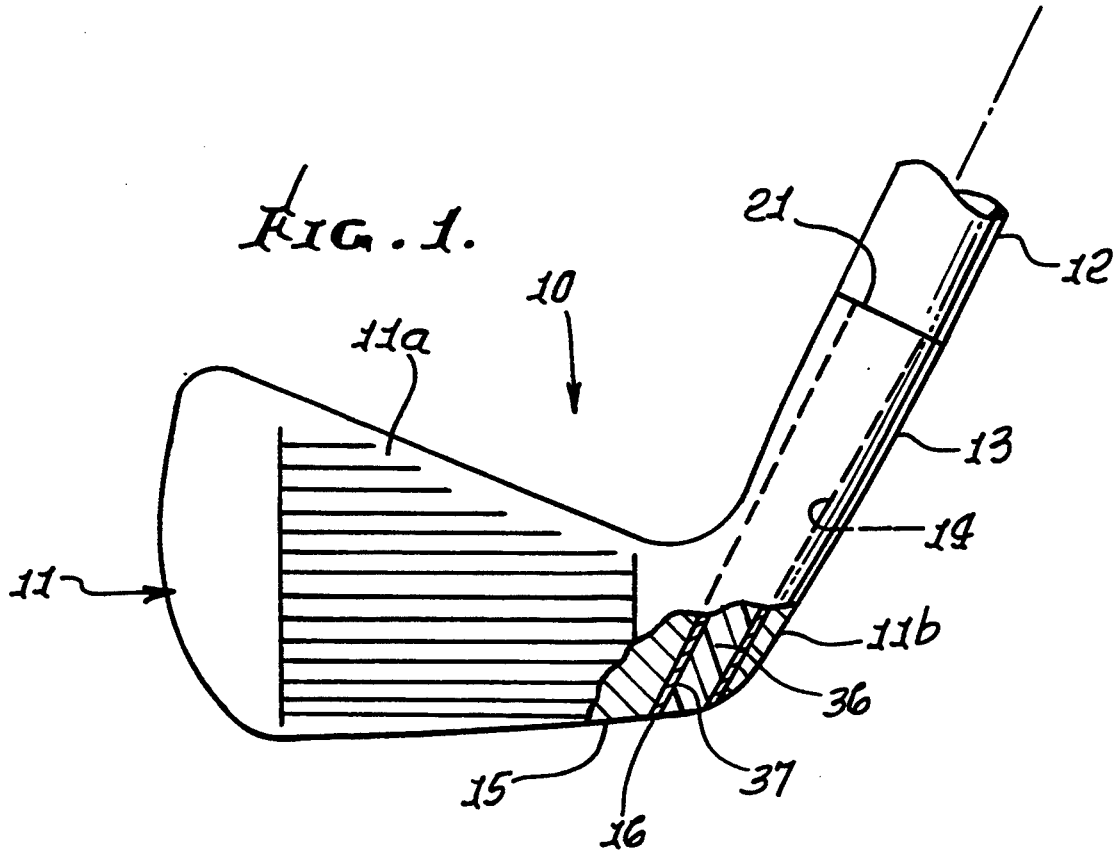
FIG. 1 is an elevation showing a golf club relating to the invention.
Figure 2:
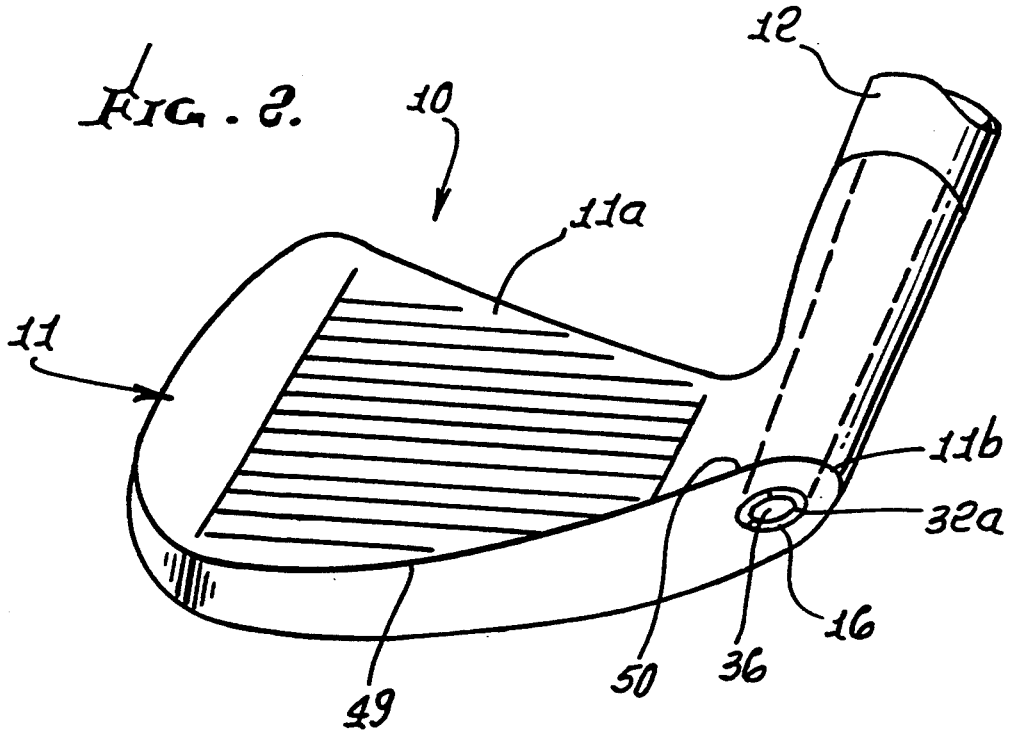
FIG. 2 is a perspective view of the front and bottom of the FIG. 1 head.
Figure 3:
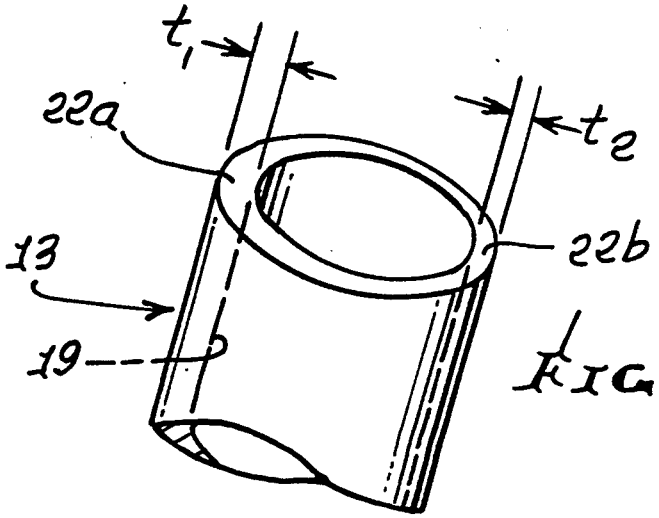
FIG. 3 is a perspective view of a mid-upper section of the hosel.
Figure 6A:
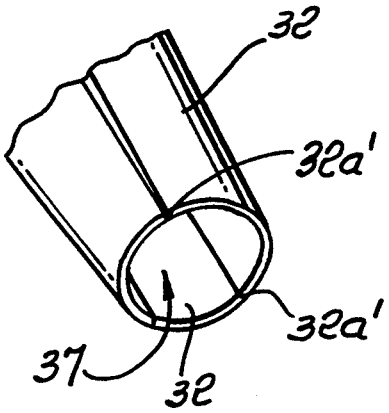

Yet another feature of the invention is the provision of a shaft lower end portion forcibly received in the socket, that shaft lower end portion having recess means whereby the lower end portion is collapsed at least in part into the recess means in response to its forcible reception into the socket. To this end, the lower end portion 30 of shaft 31 may advantageously have circularly spaced, cantilevered sections 32 which extend endwise, and have lower free ends or terminals 33, as seen in FIG. 6. Endwise extending slots 34 are formed between the metallic sections or tongues 32 to allow closure together of the sections (see FIG. 6*a*) when the sections are frictionally jammed downwardly into the tapered socket. Three to eight slots are workable. Note in FIG. 6*a* that the edges 32*a* of successive tongues may interengage at their lowermost locations 32*a*'. See also FIGS. 1 and 2. Such edge interengagement or near interengagement occurs at or near the intersection locus 16; and a plug 36 of material may be filled into the central opening 37 formed by the closing sections. In such instances, the shaft may not physically intersect the head sole itself, although the theoretical intersection still exists. A suitable plastic or powdered metal plug may be used. Also, the lower end portion 30 of the shaft may be bonded to the hosel and socket inner walls, as by a suitable bonding agent, epoxy being one example. Thus, a positively jammed together and bonded connection is provided. Shaft 31 typically consists of steel.

If the lowermost ends of the cantilever sections project below the intersection 16 upon assembly, they may be trimmed off, as by grinding.

Accordingly, a very strong, sturdy connection of the shaft to the head is provided, facilitating maximum reallocation or location or weight to or at the head itself, with maximum feel, as well as maintaining continuity of the hosel leading edge 48, and face leading edge 49, with no intersection of exit hole 16 interfering at juncture 50, 51, should such intersection at 16 exist.

Also, the head is typically cast to form surface irregularities at the bore, and against which the shaft lower end portion becomes deformed, as well as locked against twist relative to the bore.

In FIGS. 8 and 9, a graphite shaft 60 is tubular and defines a cylindrical bore 61 having an axis 62. The shaft has a lower portion 60*a* below a plane 63 normal to axis 62, that lower portion 60*a* tapering toward the lowermost end 60b of the shaft. The shaft wall thickness is greater at one side of the bore (see wall section 64) than at the opposite side of the bore (see wall thickness 65 below level of plane 63). As shown in FIG. 9, the wall section 65 has an outer surface 65*a* that tapers, toward end 60*b*, whereas, wall section 64 has outer surface 64*a* that is parallel to axis 62. The degree of taper of the shaft surfaces between 65*a* and 64*a* decreases from 65*a* to 64*a*, about the axis 62.

FIG. 10 shows the graphite shaft assembled into the hosel socket 66 in iron club head 67. The hosel socket has an upper bore 68, which is cylindrical, to receive cylindrical shaft extent 69 above plane 63. The socket also has a lower bore 70, which is tapered to match the taper of the shaft lower portion 60*a*. Thus, the hosel socket lower portion also defines an axis, corresponding to axis 62, and has an inner wall 70*a* tapering relative to that axis in an endwise direction to receive and seat the shaft tapered surface 65*a*. Socket opposite wall 73 receives sideward jamming engagement with the shaft wall surface 64*a*, as a result of jamming of shaft surface 65*a* against hosel tapered wall 70*a*. Adhesive, such as epoxy, may be used to bond the shaft and hosel walls together. The shaft tapered wall 65 faces forwardly, i.e., in the same direction as the head ball-striking face 82, i.e., in the direction of head swing.

Upon assembly, the protruding lowermost end 60*b* of the graphite shaft is typically ground off to produce the shaft flush end 60*f* in FIG. 11; and filler 80 may be introduced into the shaft bore lower end to close and seal the bore, and produce a smooth surfaced, lower surface of the head. The head itself may consist of metal, such as steel.

FIG. 11 shows a modified head 110 having a tubular shaft 111 assembled into the socket 112 of the head structure 110*a*. The head has a heel 113, a toe (not shown), a top 114, and a bottom 115, which is curved upwardly at 115*a* to meet the heel.

The socket has inner wall means extending in the direction of an axis 116, which is formed or defined by socket bore 117, and the axis may typically coincide with the shaft axis. Socket bore 117 terminates upwardly at flaring mouth 117*a*. The socket has annular wall portions relatively angled at successive locations in the direction of axis 116. See for example annular wall portion or section 118 extending downwardly between levels 121 and 122 at a slight downward taper angle $\Delta_1$; annular wall portion or section 119 extends downwardly between levels 122 and 123 at a larger downward taper angle $\Delta_2$; and annular wall portion or section 120 extends downwardly between level 123 and the head curved bottom surface 115.

As shown, the angle $\Delta_1$ is slightly tapered (for example to match the taper of the elongated shaft); $\Delta_2$ is more sharply tapered, as between 5° and 9° relative to axis 116; and $\Delta_3$ is slightly negatively tapered, as for example between −1° and −3°, relative to axis 116. Thus, for example, wall portion 118 is slightly downwardly convergent; wall portion 119 is more sharply downwardly convergent; and wall portion 120 is slightly downwardly divergent. Wall portions 119 and 120 may have about the same overall axial lengths, each of which is substantially less than the axial length of wall portion 118.

As will be understood, wall portion 119 provides a locally camming surface, for engaging the shaft lower end portion 111*a*, for collapsing or deforming same, at least in part, toward the axis, as shown in FIG. 11, in response to forcible reception of the shaft lower end portion into the socket and against that camming surface. Note the zone of relative sliding engagement at 130 of the shaft lower end portion against the tapered wall portion 119. Shaft lower end portion 111*a* is typically formed by cantilevered sections or tongues 111*b*–111*d*, seen in FIG. 13, and which are initially circularly spaced, as by axially extending slots 131–133. This facilitates closing together or collapse of the tongues toward one another in response to the camming action referred. See the description of tongues and slots in FIG. 6 above. Upon completion of such downward reception of the shaft into the socket, as shown in FIG. 11, the protruding end 111*e* of the shaft may be cut-off flush with surface 115, after expansion, as described below.

The shaft lowermost end portion 111*g* received within bore wall portion 120 is typically locked in place by expansion into engagement with wall portion 120. Thus, the shaft lower end portion at 111*f* received in bore camming wall portion 119 conforms thereto, i.e., converges downwardly; whereas, shaft lower end portion 111*g* conforms to bore wall portion 120 and diverges downwardly. This relative angling of the shaft portions 111*f* and 111*g* locks the shaft endwise in the socket. Typically, a tapered stake 140 may be driven into the partially collapsed tubular shaft at its lowermost extents 111*g* and 111*f*, to expand 111*g*, as referred to. See FIG. 12. The stake may then be cut-off along with the protruding end 111*e* of the shaft, flush with surface 115. Liquid adhesive 145, such as epoxy, may be applied into the tubular shaft before the stake is driven into FIG. 12 position, to cure in situ and bond the stake to the shaft interior.

An additional feature is the provision of clearance axially offset from camming surface 119 for reception of liquid adhesive (as for example epoxy) to contact the exterior of the shaft lower end portion, and the bore in the head, for curing and adhering the shaft lower end portion to the bore wall or walls. See for example slight annular clearance provided at 150 and extending from level 121 downwardly to level 122 to reduced clearance 150*a* adjacent the uppermost extent of camming bore wall portion 119. Liquid adhesive in that clearance also serves as a lubricant to facilitate extrusion camming of the shaft, and shaft lower end portion collapse, as referred to; also, some adhesive is carried downwardly along surface 119 and to surface 120 to provide additional adhesion of the collapsed shaft and locking shaft portions to the bore walls 119 and 120, upon assembly and adhesive curing.

The above solve the problem of shaft loosening relative to the head.

The head typically comprises a metal (steel) casting with a hosel socket defining an axis and having bore wall sections, a shaft having a lower end portion received endwise of the socket and collapsed at least in part toward the axis by endwise engagement against one of the wall sections, the lower end portion having lowermost extent which is expanded against another of the wall sections.

Likewise, the method of forming a shaft-to-head connection includes:

a) casting the head to have a bore tapering downwardly with variable taper, b) forcing the shaft lower end portion downwardly into the variably tapered bore to effect partial collapse of the shaft lower end portion against the tapered bore, c) and locking the shaft lower end portion to the bore by partial expansion of that collapsed lower end portion.

FIG. 14 shows the above principles of the invention applied to a golf club head in the form of a wood 210. Elements the same as or corresponding to elements described in FIGS. 11–13 are identified by the same numbers, but with the initial digit changed from "1" to "2". Note hosel 270 within the head, i.e., between the top wall 271 and bottom wall 272. Hosel rear wall 270*a* is at the heel of the head.

We claim:

1. In a golf club having a head, and a shaft defining an axis, the head having a heel, a toe, a top, and a bottom, an improved connection of the shaft to the head comprising in combination:

a) a socket associated with the head, the socket having inner wall means extending in the direction of said axis, and with annular wall portions relatively angled at axially successive locations in said direction, at least one of said wall portions providing a locally camming surface, b) the shaft having a lower end portion forcibly received endwise into said socket, and collapsed at least in part toward said axis in response to said forcible reception of the shaft lower end portion into the socket, and against said camming surface, c) said wall means forming, with said shaft lower end portion, a clearance axially offset from said camming surface for reception of adhesive to contact the shaft lower end portion and to cure and adhere the shaft lower end portion to said wall means.

2. The combination of claim 1 wherein said wall means include a first downwardly tapered wall portion defining said camming surface, and a second wall portion intersecting said first wall portion at an angle.

3. The combination of claim 2 wherein said angle is an obtuse angle in an axial radial plane intersecting said first and second wall portions.

4. The combination of claim 2 wherein said first wall portion defines a frusto-conical surface having larger and smaller ends and which converges downwardly.

5. The combination of claim 4 wherein said second wall portion defines a substantially cylindrical surface intersecting the larger end of said frusto-conical surfaces.

6. The combination of claim 5 wherein said wall portions include a third wall portion intersecting the smaller end of said frusto-conical surface.

7. The combination of claim 6 wherein said third wall portion defines a surface, which diverges downwardly.

8. The combination of claim 7 wherein the socket has a lower end portion, and including a stake in said lower end portion acting to spread the lowermost extent of said shaft collapsed lower end portion into adjacent relation to said substantially cylindrical surface.

9. The combination of claim 8 including a filler in said socket lower end portion adjacent said stake.

10. The combination of claim 8 wherein said secondary surface extends to said head bottom, and said lowermost extent of said shaft collapsed lower end portion includes tongues extending generally in the direction of said axis.

11. The combination of claim 7 wherein said secondary surface extends to said head bottom.

12. The combination of claim 1 wherein the shaft lower end portion includes tongues extending in the direction of said axis, and the tongues are spaced about said axis.

13. The golf club head of claim 1 which comprises an iron.

14. The golf club head of claim 1 which comprises a wood.

15. A golf club comprising a head and defining a hosel socket defining an axis and having bore wall sections, a shaft having a lower end portion received endwise of said socket and collapsed at least in part toward said axis by endwise engagement against one of said wall sections, said lower end portion having a lowermost extent which is expanded against another of said wall sections.

16. The golf club of claim 15 wherein said shaft lower end portion is within the head.

17. The method of forming a shaft-to-head connection including:

a) casting the head to have a bore tapering downwardly with variable taper, b) forcing the shaft lower end portion downwardly into the variably tapered bore to effect partial collapse of the shaft lower end portion against the tapered bore, c) and locking the shaft lower end portion to the bore by partial expansion of that collapsed lower end portion.

18. In the method of forming a connection between a golf club head and shaft, the shaft having a lower end portion provided with a recess and capable of partial collapse, and having differential dimensions at opposite sides of said recess, the steps that include:

a) casting the head to have a hosel bore tapering downwardly with variable taper, b) forcing said shaft differential dimensions lower end portion downwardly into said variably tapered bore to effect jamming of the shaft lower end portion against said tapered bore.

19. The method of claim 18 wherein the head is cast to form surface irregularities at said bore, and against which the shaft lower end portion becomes jammed.

20. In the method of forming a connection between a golf club head and shaft, the shaft having a lower end portion and capable of partial collapse, and having differential dimensions at opposite sides of said recess, the steps that include:

a) casting the head to have a hosel bore tapering downwardly with variable taper, within said head, b) forcing said shaft lower end portion downwardly into said bore to effect jamming of the shaft lower end portion against said tapered bore, within said head.

21. The method of claim 20 wherein the head is cast to form surface irregularities at said bore, and against which the shaft lower end portion becomes jammed.

22. In the method of forming a connection between a golf club head and shaft, the head having a top, a bottom, a heel, and a toe, the shaft having a lower end portion and capable of partial collapse, the steps that include:

a) casting the head to have a hosel socket between the top and bottom of the head, b) and forcing said shaft lower end portion downwardly into said socket to effect partial collapse and jamming of the shaft lower end portion against said socket, within the head.

* * * * *